US012077922B2

(12) United States Patent
Scott

(10) Patent No.: US 12,077,922 B2
(45) Date of Patent: Sep. 3, 2024

(54) GRAVEL SCARIFYING AND LEVELLING DEVICE WITH INTEGRATED ROLLER DEVICE AND METHODS OF USE THEREOF

(71) Applicant: Norman L Scott, Port Lambton (CA)

(72) Inventor: Norman L Scott, Port Lambton (CA)

(73) Assignee: Norman L. Scott, Port Lambton, CA (US)

( * ) Notice: Subject to any disclaimer, the term of this patent is extended or adjusted under 35 U.S.C. 154(b) by 673 days.

(21) Appl. No.: 17/193,401

(22) Filed: Mar. 5, 2021

(65) Prior Publication Data

US 2021/0277612 A1 Sep. 9, 2021

Related U.S. Application Data

(60) Provisional application No. 62/986,982, filed on Mar. 9, 2020.

(51) Int. Cl.

| | |
|---|---|
| ***E01C 23/082*** | (2006.01) |
| ***E01C 19/26*** | (2006.01) |
| ***E01C 19/28*** | (2006.01) |
| *E01C 23/088* | (2006.01) |

(52) U.S. Cl.

CPC ..... *E01C 23/082* (2013.01); *E01C 19/264* (2013.01); *E01C 19/285* (2013.01); *E01C 23/088* (2013.01)

(58) Field of Classification Search

CPC .... E01C 19/285; E01C 19/264; E01C 19/266; E01C 19/28; E01C 19/281; E01C 23/082; E01C 23/085; E01C 23/088; E02F 3/627; E02F 3/7604; E02F 3/7622; E02F 3/7631; E02F 3/967; E02F 3/962; E02F 3/963; E02F 3/964; A01B 29/00; A01B 29/06; A01B 49/02; A01B 49/027; A01B 63/008; A01B 63/10

See application file for complete search history.

(56) References Cited

U.S. PATENT DOCUMENTS

| | | | | | |
|---|---|---|---|---|---|
| 3,274,713 | A * | 9/1966 | Jones | E02F 3/8155 | 172/197 |
| 3,448,814 | A * | 6/1969 | Bentley | A01B 49/027 | 172/170 |
| 3,470,964 | A * | 10/1969 | West | A01B 31/00 | 172/197 |
| 3,998,276 | A * | 12/1976 | MacMillan | A01B 49/022 | 172/70 |

(Continued)

FOREIGN PATENT DOCUMENTS

RU 182660 U1 * 8/2018

*Primary Examiner* — Tara Schimpf
*Assistant Examiner* — Michael A Goodwin
(74) *Attorney, Agent, or Firm* — Troutman Pepper Hamilton Sanders LLP (Rochester)

(57) ABSTRACT

A scarifier device includes a scarifier comprising a scarifier support frame having a plurality of downwardly depending axially secured scarifying teeth. An integrated roller device having a compaction roller on a roller support frame is pivotally coupled to the scarifier support frame. A hydraulic arm is positioned between the scarifier support frame and the roller support frame to articulate the roller device between a deployed position and a retracted position. Methods of making and using the scarifier device are also disclosed.

16 Claims, 13 Drawing Sheets

(56) References Cited

U.S. PATENT DOCUMENTS

| | | | | | |
|---|---|---|---|---|---|
| 4,217,962 | A * | 8/1980 | Schaefer | E02F 3/6454 | 172/197 |
| 5,265,975 | A * | 11/1993 | Scott | E01C 23/082 | 172/197 |
| 5,407,014 | A * | 4/1995 | Tranmer | A01B 19/02 | 172/197 |
| 5,511,625 | A * | 4/1996 | Mork | E02F 3/8152 | 172/449 |
| 5,833,011 | A * | 11/1998 | Boertlein | E02F 5/32 | 172/197 |
| 2008/0069639 | A1* | 3/2008 | James | E02F 3/967 | 404/104 |
| 2011/0284253 | A1* | 11/2011 | Stevenson | A01B 49/027 | 172/311 |
| 2017/0037583 | A1* | 2/2017 | Gillespie | E01C 19/00 | |
| 2018/0127948 | A1* | 5/2018 | Villalba Hernández | E02F 3/7622 | |

* cited by examiner

GRAVEL SCARIFYING AND LEVELLING DEVICE WITH INTEGRATED ROLLER DEVICE AND METHODS OF USE THEREOF

This application claims benefit of U.S. Provisional Patent Application No. 62/986,982, filed Mar. 9, 2020, the entirety of which is incorporated herein by reference.

FIELD

The present technology relates to devices for scarifying and levelling gravel roadways, parking lots, and the like. More specifically, the present technology relates to a gravel scarifying and leveling device with an integrated roller device and methods of use thereof.

BACKGROUND

Gravel roads, gravel shoulders, gravel parking lots, all exemplify the use of gravel in economically facilitating both vehicular and pedestrian traffic over defined areas and routes. For various reasons, the use of gravel in these applications can be very much more attractive than the alternatives afforded by asphalt and concrete paving.

The use of gravel, however, is not without its own complications. Uneven compaction over the travelled surface can lead to the formation of wheel ruts, while turning, accelerating or decelerating traffic can lead to local phenomenon such as potholes and corrugations; and, the aggregate material will itself tend to undergo a sorting, by particle size, attributable to differential compaction effects, the results of all of which are less than attractive. In some cases, these effects represent safety hazards.

One solution to the degradation of such gravel emplacements has been to simply add additional gravel over the surface, as needed. Interestingly, there is only a limited consolidation between the added material and the underlying surface, which tends to leave the upper, relatively unconsolidated material in an easily disturbed layer from which aggregate material tends to be rapidly displaced. Moreover, commercial sources of aggregate depend of naturally occurring gravel deposits, and like most natural resources, their numbers are becoming depleted. Although the existence of many more marginal deposits stave off any likelihood of critical shortages of supply, the costs of harvesting a more marginal deposit is inherently higher, and this is reflected in higher gravel costs.

As a consequence, the historical practice most often adopted to remediate gravel roads, parking lots and the like, have entailed the use of large, powerful road graders, equipped with scarifiers. A grader is, by definition, a machine with a centrally located blade that can be angled to either side. Typically, graders have a reinforced tubular or box-beam "Y" frame supporting the engine at the rear of the vehicle, between the arms of the "Y." Drive wheels, usually arranged in tandem, are positioned below the engine and transmission, while steering wheels are arranged on an axel system at the point of the "Y" frame. The major attachments for the grader are secured in downwardly hung relation from the overhead portions of the frame, and are pulled by a drawbar reaching back from the front of the frame. These attachments include the blade and the scarifier.

More specifically, the blade is arranged on a toothed ring gear called the "circle," on which the attachments can be rotated. An arm-type attachment between the "circle" and the frame allow the circle to be controllably lifted, lowered, offset to either side, or even to be placed into a vertical configuration. The scarifier is typically position in front of the blade, and is carried on a pair of arms that reach back from the front end of the graders frame. The scarifier can be raised and lowered to regulate the depth of penetration, relative to the bottom of the graders tires. The number of teeth used on the scarifier is dependent on the hardness of the surface being worked.

Attempts at smaller scale scarifiers have been unsuccessful from a performance point of view, and have not enjoyed commercial acceptance. One such attempt took the form of a towed "box scarifier." This consisted of a scarifier and a plough blade arranged at opposed ends of a frame which a had a box shaped plan. The device was dragged along by a vehicle with the intention that the scarifier would turn up the underlying aggregate and the plough blade would evenly redistribute it. Unfortunately the device was neither heavy enough to scarify properly, nor did it afford the control necessary to evenly redistribute even such material as was dislodged by the scarifier teeth. The problem is similar to that encountered with very early attempts to use towed road construction rippers, the use of which has now apparently been abandoned. Towed rippers too, proved to be unsatisfactory due to poor penetration. If sufficient weight was added to the towed ripper to insure effective penetration, the ripper became too heavy for any but the largest of commercial tractor vehicles. These towed rippers were also rather unwieldy, and hard to maneuver. Lastly, such rippers were not grading devices, and are simply a battery of teeth mounted on a wheeled vehicle.

Towed graders were also known. These were produced in an attempt to deal with a number of grader-related problems, but are now considered outmoded. Their use required two skilled operators, which was an offset to the presumed advantage of reduced capital and maintenance costs. They were in any case, found to be hard to maneuver even relative to motorized graders, and were never known to be used in scarifying operations. There is the further problem that the tow vehicle tends to compact the material that the towed grader was intended to redistribute in a level manner.

Accordingly, the only known commercially viable practice continues to rely on the use of motorized graders. Graders provide sufficient weight and power to force the scarifier teeth into the ground and drag it along, together with the control necessary to position a grader blade for proper redistribution of the dislodged materials.

The problems that are and have always been immediately apparent in connection with the use of graders for this purpose continue to be a problem, however. These include a requirement for a highly skilled operator. Moreover, graders are not highly maneuverable, a problem which is a function of the very size and weight heretofore thought necessary to achieve scarifying/grading operations. Moreover, the economics of grader operation are very sensitive. For example, straight line grading patterns that cover less than 1000 linear feet, are economically inefficient because of the operating/time costs associated with turning the grader around. Even were the economics otherwise, the large size of graders make them difficult or even impossible to maneuver in the manner necessary to service the close quarters that characterize many gravel emplacements. The travelling costs of grader equipment are very high, and some jobs are often not done at all particularly if they are in geographically isolated areas. Graders also cannot access corners because of the positioning of the blade.

Scarifiers have been developed that are compatible with other devices, such as rollers. However, prior scarifiers connect the roller to a single central point on the frame with limited ability to manipulate the roller device when attached. Such devices suffer from a lack of control over the attached devices.

DETAILED DESCRIPTION

Figure 1:
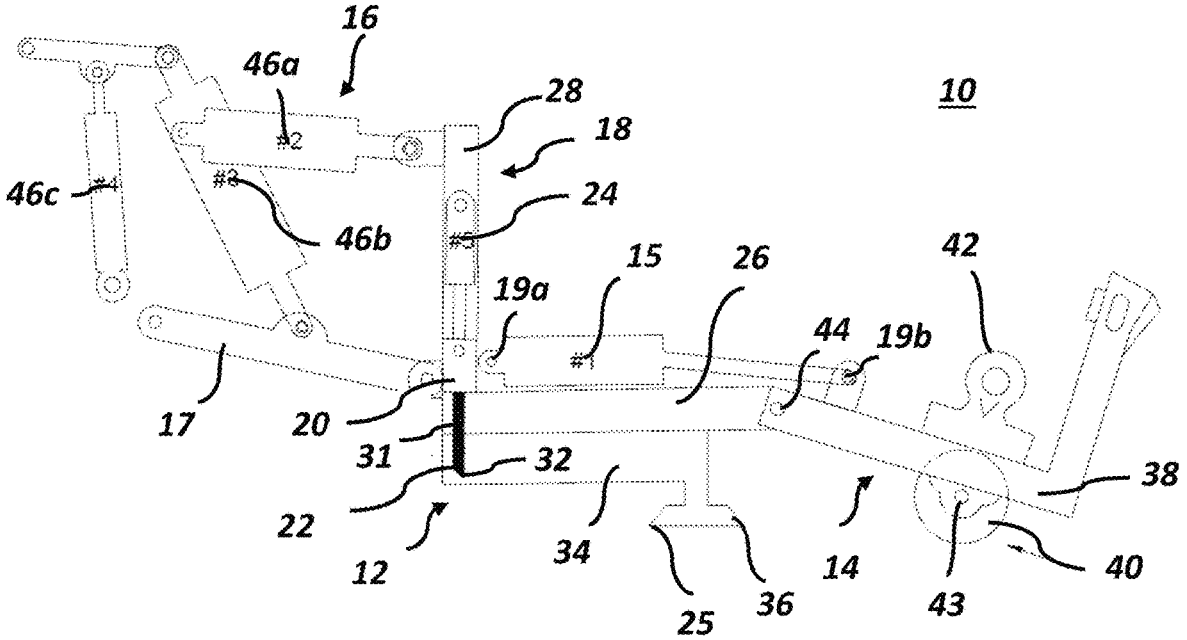
FIG. 1 is a side schematic cross-sectional view of an example of a scarifier device with an integrated retractable roller device that is in a fully extended (deployed) position.

Referring to FIGS. 1-4, an exemplary scarifier device 10 having a scarifier 12 and an integrated retractable roller device 14 is illustrated in various deployment positions. The scarifier device 10 includes the scarifier 12 and the roller device 14 coupled together in an articulating manner by hydraulic cylinder 15 as described in further detail below, although the scarifier device 10 can include other types and/or numbers of elements, components, or devices in other combinations. In the illustrated examples, the scarifier device 10 is illustrated coupled to a hitch device 16. The hitch device 16 allows the scarifier device 10 to be attached to a tractor, by way of example only.

The scarifier device 10 advantageously provides an improved scarifier for scarifying and levelling gravel roadways, parking lots, and the like, that incorporates the integrated roller device 12 that can be manipulated by articulation to provide a number of advantages as discussed herein. For example, the scarifier device 10 can be used to scarify and/or level any granular surfaces such as gravel, crushed coral and sea shells, flint, sandstone, granite, shale, or limestone, although the scarifier device 10 could be used on other granular surfaces. The scarifier device 10 provides improved efficiency and an improved finished product during scarifying and/or levelling operations. Specifically, the user can control the position of the integrated roller device 12 to improve scarifying and leveling functions as described herein.

In this example, the scarifier 12 includes a support frame 18, bracket member 20, teeth 22, hydraulic arms 24, and a blade 25 although the scarifier 12 can include other types and/or other numbers of elements in other combinations. The scarifier 12 is configured for scarifying and levelling gravel roadways, parking lots, and the like, by way of example only. In one example, the scarifier 12 is similar in structure and operation to the scarifier disclosed in U.S. Pat. No. 5,265,975, the disclosure of which is incorporated herein by reference, except as discussed below.

In particular, as discussed in detail below, the scarifier 12 is advantageously configured as part of the scarifier device 10 that includes the fully integrated roller device 14 to allow for manipulation of the roller device 14 in an articulated manner to provide improved functionality of the scarifier 12. Further, although the scarifier 12 is shown in cross-section, it is to be understood for the purposes of the disclosure that symmetrical aspects may described in the plural form although only one of the elements is illustrated.

The support frame 18 in this example includes lower horizontal support frame portions 26, vertical support frame portions 28, and upper horizontal support frame portions (not shown). The terms horizontal, vertical, upper, and lower are utilized with respect to the standard orientation of the elements during operation of the scarifier device 10 and are not intended to be limiting. The support frame 18 is configured to be coupled to the integrated roller device 14 as described in further detail below. The vertical support frame portions 28 include vertically extending channels (as shown in cross-section) that allow for linear movement of the bracket portion 20 within the channels of vertical support frame portions 28 using hydraulic arms 24.

The bracket portion 20 holds the plurality of teeth 22 (although a single tooth is shown in FIGS. 1-4 it is to be understood that the scarifier could include a plurality of teeth as known in the art). In one example, the bracket portion 20 holds six or more teeth that are spaced approximately 6 inches apart, although other numbers of teeth in other configurations can be utilized. Bracket portion 20 is linearly moveable within the vertically extending channels of the vertical support frame portions 28 of the support frame 18 using the hydraulic arms 24.

Figure 5:
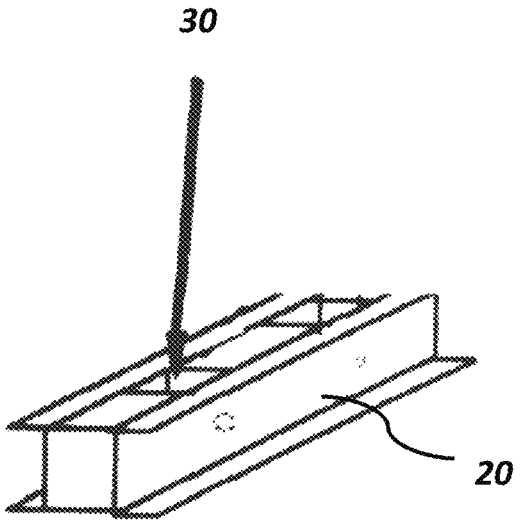
FIG. 5 illustrates pockets in a bracket portion for receiving teeth in the scarifier device with the integrated retractable roller device of FIG. 1.
Figures 6A, 6B:
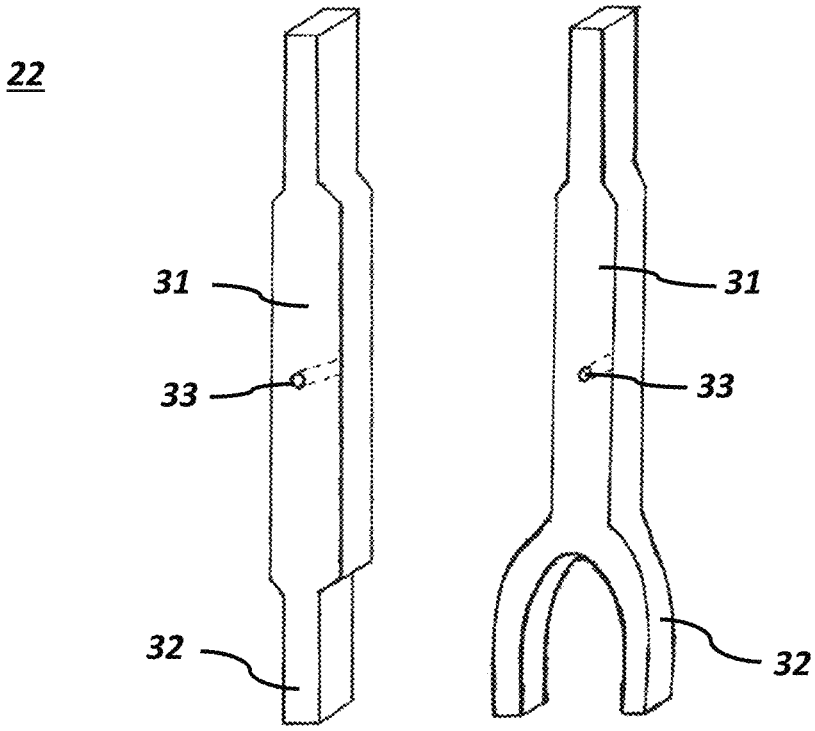
FIGS. 6A and 6B are schematic views of examples of teeth that may be employed in the scarifier device with the integrated retractable roller device of FIG. 1.

As illustrated in FIG. 5, in one example the lower side of bracket portion 20 includes pockets 30 adapted to receive the teeth 22. The pockets 30 are configured to provide a clearance between the edges of the pockets 30 and a shank 31 of the teeth 22. By way of example, the pockets 30 may be configured to have dimensions of 1.5" by 1.5" to hold teeth that are 1" by 1", although other configurations could be utilized to provide the clearance. The pockets 30 are larger than prior designs to allow for increased lateral and longitudinal movement of the teeth 22 to increase efficiency (i.e., area coverage). The clearance between the edges of the pockets 30 and the shank 31 of the teeth 22 allow lateral freedom for displacement of the teeth 22 during use of the scarifier device 10. In one example, the pockets 30 are configured such that the later movement of the teeth 22 within the pockets 30 is limited to about 30 degrees of movement from side to side within the pockets 30. The bracket portion 20 can receive the teeth 22 as described in U.S. Pat. No. 5,265,975, the disclosure of which is incorporated herein by reference, by way of example only. In another example, the teeth 22 have a hole 33 in a middle portion (as shown in FIGS. 6A and 6B) that may be secured within the bracket portion 20 by a pin that extends from the front to the rear of the device. This configuration allows the teeth 22 to toggle at both ends with about 15-20 degrees of freedom. The teeth 22 can also vibrate from the front to back as a result of an impact force on the device.

The teeth 22 include the shank 31 and tips 32 that are utilized in the scarifying and leveling operations as described herein. FIGS. 6A and 6B illustrate examples of teeth having tips 32 with a single point contact configuration (FIG. 6A) and a double point contact configuration (FIG. 6A). FIG. 6A shows a narrowed tooth design in the shank area that allows for better penetration without the tooth breaking or bending. FIG. 6B shows a double point contact configuration that advantageously provides for improved performance during grass removal operations. This configuration allows for more surface area with less penetration for grass removal.

Referring again to FIGS. 1-4, the scarifier 12 includes a pair of spaced apart hydraulic cylinders 24 (although a single hydraulic cylinder 24 is shown in FIGS. 1-4, it is to be understood that multiple cylinders should be employed) that are operably connected between upper horizontal portion of the support frame 18 and bracket member 20 to allow for moving bracket member 20 within the vertically extending channels of the vertical support frame portions 28 of the support frame 18 to change the position of the teeth 22 during operation.

The blade 25 is secured to the support frame 18 of the scarifier 12 through a second frame 34 that is rigidly co-joined to the support frame 18. The blade 25 includes a trailing shoe 36 that can be usefully employed in free floating the blade during levelling operations, as will be apparent to persons skilled in the art in light of the present invention. In this frame arrangement, the scarifier 12 and the blade 25 are co-operable in a mutually dependent relation.

The roller device 14 includes a roller support frame 38, roller 40, and vibration device 42, although the roller device 14 can include other types and/or other numbers of elements in other combinations. The roller support frame 38 is configured to be coupled to the support frame 18 of the scarifier 12 as discussed in further detail below. The roller support frame 38 also supports the roller 40. The roller 40 may be any roller known in the art for levelling operations and is coupled to the roller support frame by an axle 43. In one example, the roller 40 provides a 12 inch drum, although other size rollers may be employed.

Figure 7A:
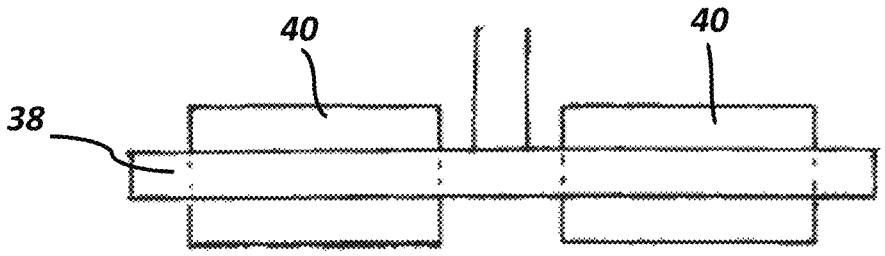
FIGS. 7A-7C illustrate an exemplary dual roller configuration that may be employed in the scarifier device with the integrated retractable roller device of FIG. 1 in various deployment positions.
Figure 7B:
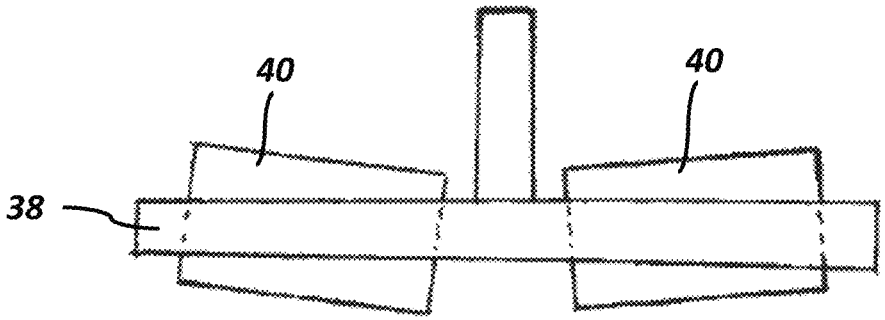
Figure 7C:
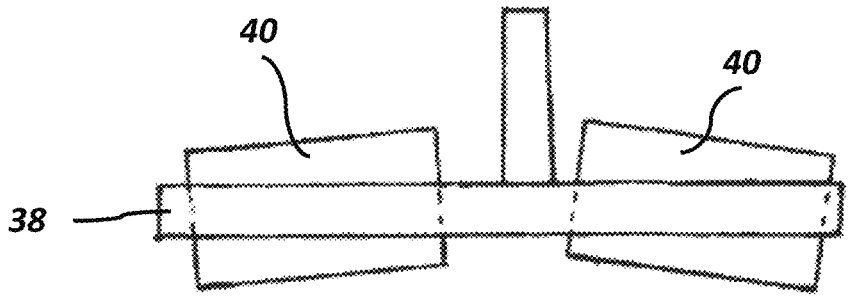

In one example, as illustrated in FIGS. 7A-7C, a pair of the rollers 40 can be employed. In this example, the axles of the rollers 40 are mounted in swivel pillow block bearings that allow the angle of the rollers 40 to be altered as shown in FIGS. 7B and 7C. This configuration advantageously allows the rollers 40 to compress the edges of a pathway towards the middle (FIG. 7B), or from the middle out (FIG. 7C), thus developing a crown along the pathway. The roller support frame 38 can further support the vibration device 42, which allows the device to be vibrated during operation as described in further detail below. In one example, the vibration device 42 is a 3500 psi vibro unit, although other vibration devices 42 could be utilized.

Figure 2:
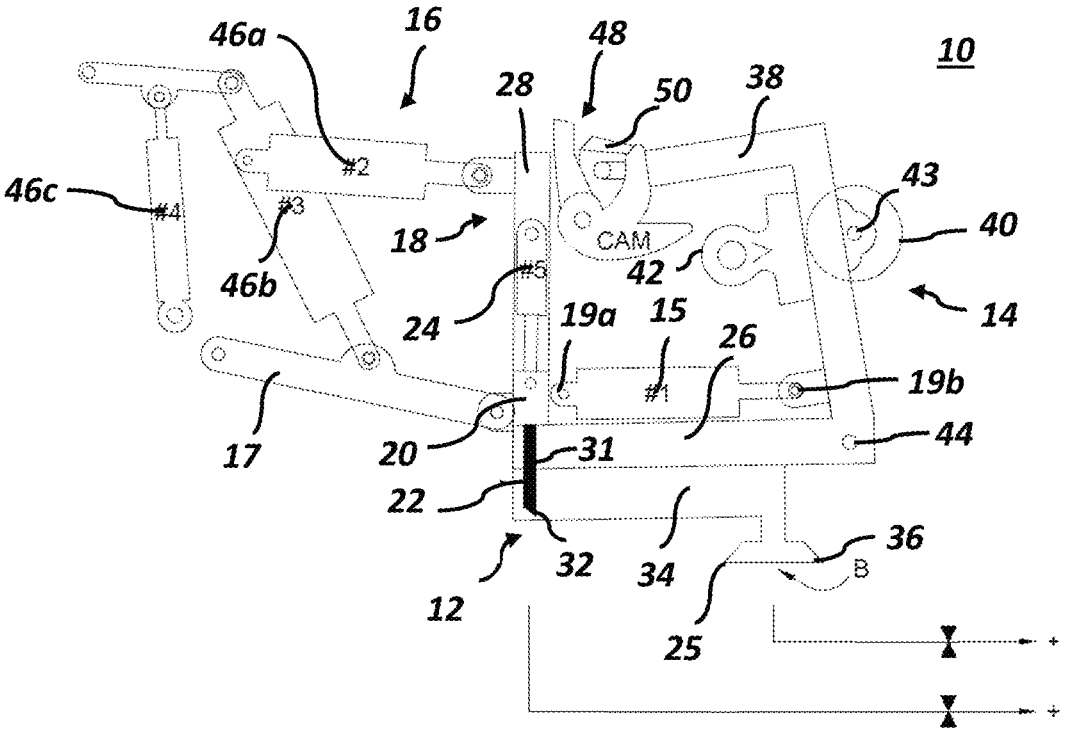
FIG. 2 is a side schematic cross-sectional view of the scarifier device with the integrated retractable roller device of FIG. 1 with the integrated roller device in a fully retracted position.

The scarifier 12 is coupled to the roller device 14 at a pivot 44. The pivot 44 allows for articulation of the roller device 14 between the fully extended position as shown in FIG. 1 to the fully retracted position shown in FIG. 2. Hydraulic arm 15 is coupled between the scarifier 12 and the roller device 14 at connection points 19A and 19B, respectively, as shown in FIGS. 1 and 2. The hydraulic cylinder 15 controls the positioning of the roller device 14, which allows the user to manipulate the roller 40 of the roller device 14 by articulation to obtain various different positions. In one example, the position of the roller 40 is manipulated to address varying gradients and ground conditions, by way of example only.

In this example, the hitch device 16 provides a three-point hitch connection for the scarifier device 10. The hitch device 16 is pivotally coupled to the vertical frame portion 28 through oversize holes configured to receive an undersized connection pin to allow for lateral displacement of the teeth 22 during operation. The hitch device 16 includes hydraulic cylinders 46*a*-46*c* that allow for operation various operations of the hitch device 16. The hitch device 16 allows for the scarifier device 10 to be coupled to a tractor, by way of example only.

Figure 12:
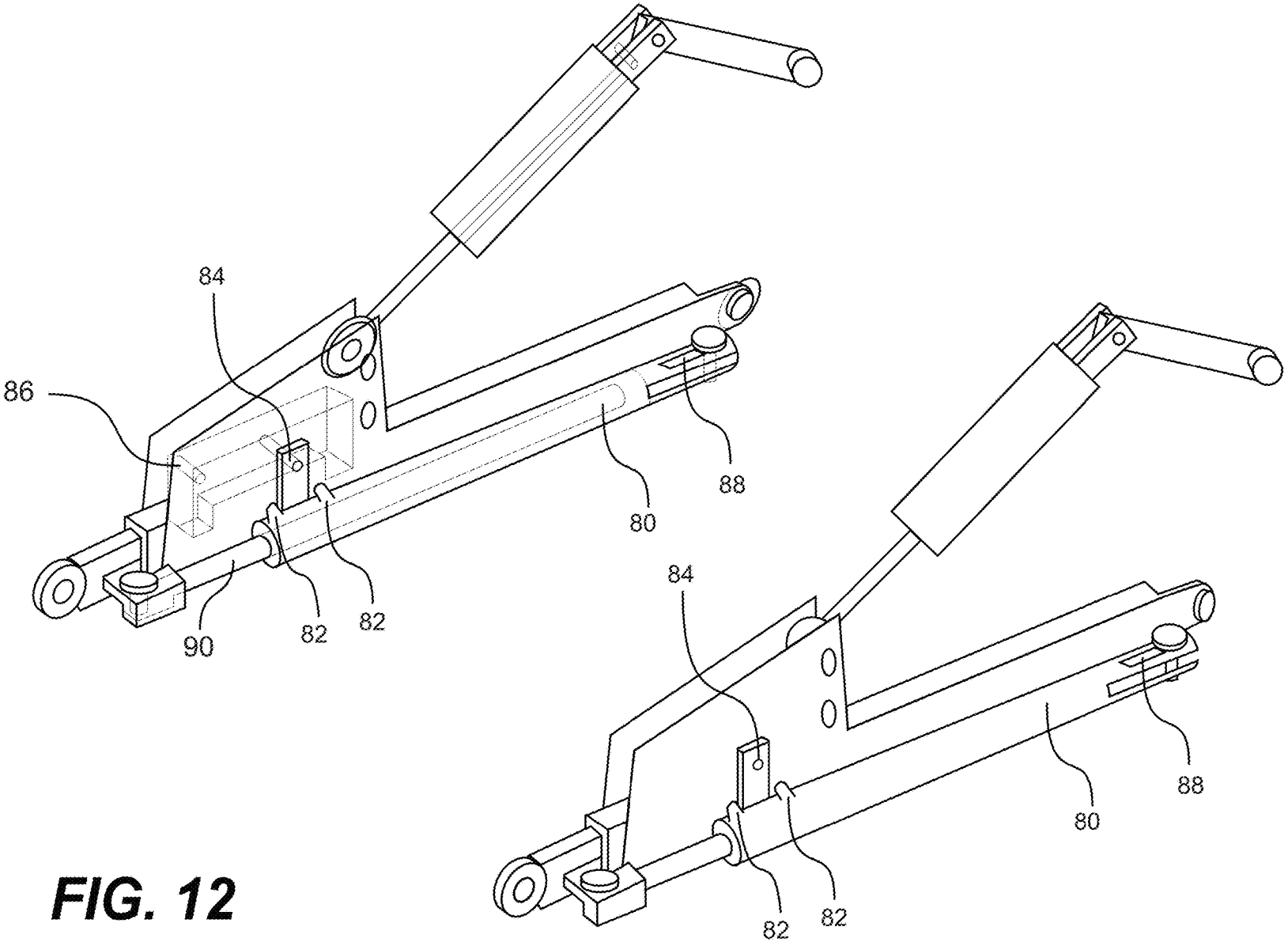
FIG. 12 illustrates a perspective view and an exploded phantom view, respectively, of an angler/unloader arm that may be employed with the scarifier device.

In one example, the hitch device 16 also includes arm 17, which is shown in detail in FIG. 12. Although single arm 17 is illustrated it is to be understood that two arms may be employed in a symmetric fashion on each side of the hitch device. Arm 17 provides an angler/unloader that may be employed to manipulate the scarifier device 10 during operation. Referring more specifically to FIG. 12, the arm 17 includes a hydraulic cylinder 80, lugs 82, toggle 84, lock 86, slot 88, and piston rod 90, although the arm 17 may include other elements in other combinations. When the lock 86 is engaged, the piston rod 90 of the arm 17 is isolated from any impacts during operation of the scarifier device 10. One end of the hydraulic cylinder 80 is pinned to an extension arm and the other end includes the slot 88.

As a result, in operation, extension of the hydraulic cylinder 80 causes the barrel of the hydraulic cylinder 80 to move toward the rear of the tractor to which the scarifier device 10 is attached to by hitch device 16, by way of example. As the barrel of the hydraulic cylinder 80 moves rearward, the lugs 82 attached to the hydraulic cylinder 80 actuate the toggle 84, which releases the lock 86 on the extension arm. When the barrel of the hydraulic cylinder 80 reaches the end of its stroke in the slot 88, the piston rod 90 moves away from the rear of the tractor and angles the scarifier device 10, which may be employed in any of the operations described herein. The hydraulic cylinder 80 may then be moved in the opposite direction to reverse the process.

Figure 8A:
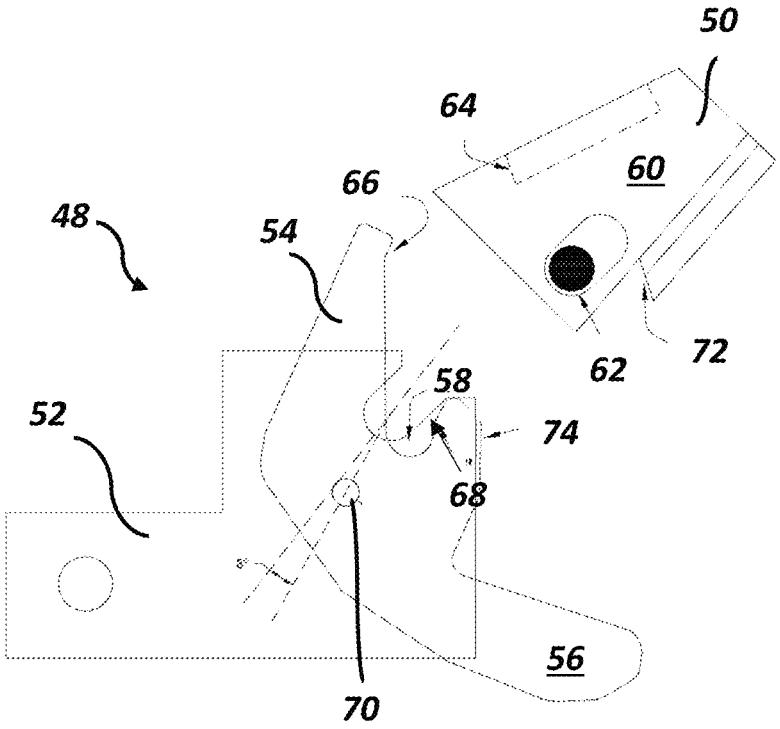
FIG. 8A illustrates an exemplary cam lock system that may be employed in the scarifier device with the integrated retractable roller device of FIG. 1.
Figure 8B:
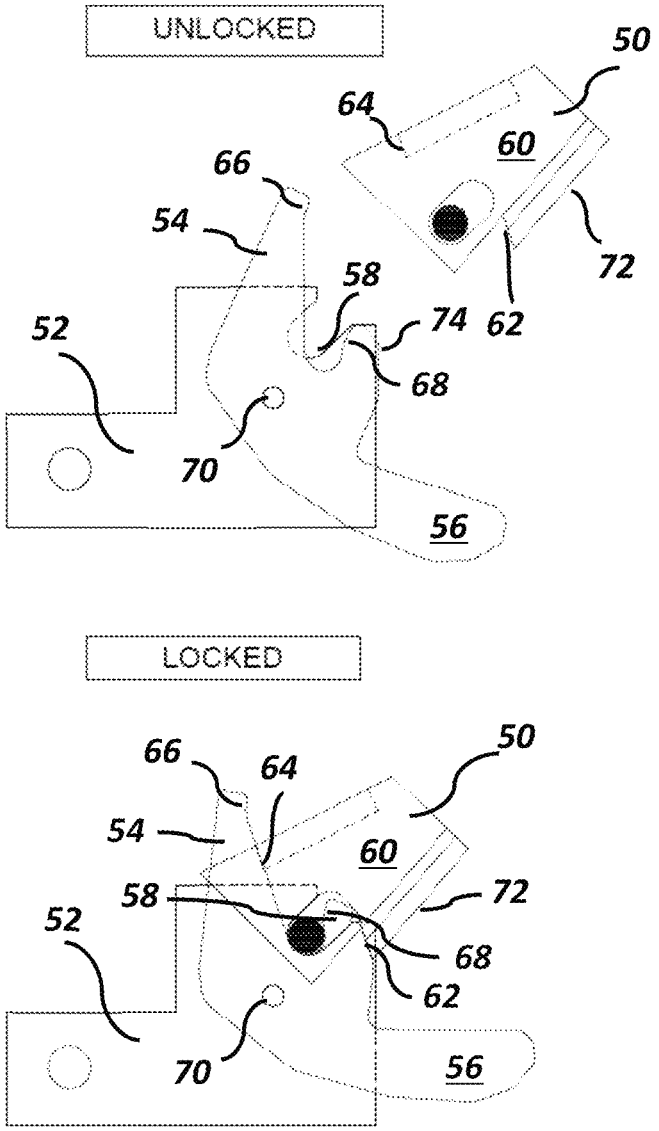
FIG. 8B illustrates the exemplary cam lock system of FIG. 8A in unlocked and locked positions.

Referring now more specifically to FIG. 2 and FIGS. 8A and 8B, in one example the scarifier device 10 further includes a cam lock 48 that interacts with a pin mechanism 50 in order to secure the roller device 14 to the scarifier 12 when the scarifier device 10 is in the fully retracted position as shown in FIG. 2. The pin mechanism 50 is located on the roller support frame 38 in order to interact with the cam lock 48 when the scarifier device 10 is in the fully retracted position as shown in FIG. 2.

Figure 9A:
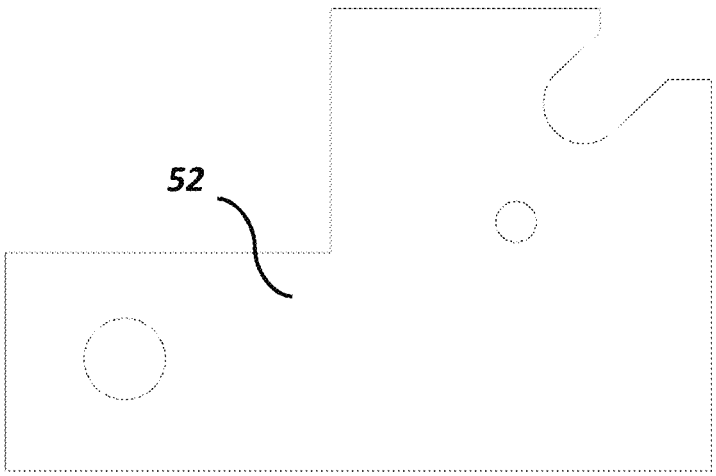
FIGS. 9A and 9B illustrate a mainframe and a locking portion of the cam lock shown in FIGS. 8A and 8B.
Figure 9B:
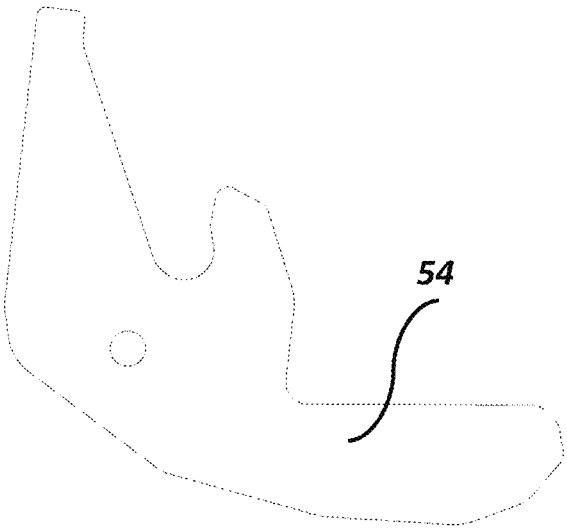

Referring more specifically to FIGS. 8A, 8B, 9A, and 9B, the cam lock 48 includes a mainframe 52 (FIG. 9A) and a locking portion 54 (FIG. 9B). In the unlocked position, counterweight 56 of the locking portion 54 of the cam lock 48 holds throat 58 on the mainframe 52 of the cam lock 48 open. Pin slot 60 on the roller device 12 allows pin 62 to advance toward the cam lock 48 as it tilts forward, automatically centering the pin 62 with the throat 58 of the cam lock 48. Locking surface 64 on the pin slot 60 engages counter-part level 66 on the cam lock 48 at a 2-1 leverage, by way of example, which closes the cam throat 58 contacting the pin 62 to be held firmly in the cam throat 58. The cam surface at point 68 contacts the pin 62 and wedges it tightly in the cam throat 58 to immobilize the pin 62. Pivot hole 70 of the cam lock 48 is offset from the main frame centerline by approximately 8 degrees, by way of example, to create a wedge lock that further tightens the grip of the cam lock 48 on the pin 62. Additionally, second lock surface 72 contacts the cam surface at point 74 further ensuring the locking force on the pin 62.

The locking force is generated by hydraulic pressure, the use of leverage, and the weight of the roller device 14. In one example, the locking force is sufficient to securely hold the roller device 14 in position during use of the vibration device 42, which may be a 3500 psi vibro unit. The face of the cam lock 48 is convex and protrudes at the point 68 where it contacts the pin 62. This feature, along with the 8 degree offset of the pivot hole 70 allows for part wear and will ensure the tightness of the cam lock 48 as it wears over time.

In one example, the scarifier 12 is sized and configured to allow the cam lock 48 to hold the roller device 14 securely in place. In one example, in the retracted position shown in FIG. 2, an angle between the connection point 19*a*, pivot 44, and connection point 19*b* is about 35 degrees; an angle between the connection point 19*a*, connection point 19*b*, and pivot 44 is about 135 degrees; and an angle between the connection point 19*b*, connection point 19*a*, and pivot 44 is about 10 degrees, although other configurations may be employed based on the dimensions of the scarifer 12 and roller device 14. In one example, in the retracted position shown in FIG. 2, an angle from the pin mechanism 50, pivot 44, and connection point 19*b* is about 8 degrees; an angle from pivot 44, connection point 19*b*, and pin mechanism 50 is about 170 degrees; and an angle from connection point 19*b*, pin mechanism 50, and pivot 44 is about 2 degrees, although other configurations may be employed based on the dimensions of the scarifier 12 and roller device 14.

Exemplary operations of the scarifier device 10 will now be described. The scarifier device 10 can be put into the fully deployed position, as a shown in FIG. 1, using a combination of leverage and the hydraulic arm 15, although any of the other cylinders can be manipulated to put the scarifier device 10 in the fully deployed position. In the fully deployed position, the scarifier 12 is raised vertically such that it is suspended above the ground, thereby exerting a further downward force on the roller 40, in addition to the weight of the roller 40 alone. The downward force on the roller 40 is variable based on manipulation of the hydraulic arm 15. Thus, the user can advantageously vary the amount of compaction applied by the roller 40 in the deployed position.

Further, in the deployed position the vibration mechanism 42 can be utilized to further enhance compaction as the vibration mechanism 42 provides vibrations that provide particle dispersion and settlement. Accordingly, the use of the vibration mechanism 42 provides for better surface performance and longevity for the surface worked upon by the roller device 14.

Figure 3:
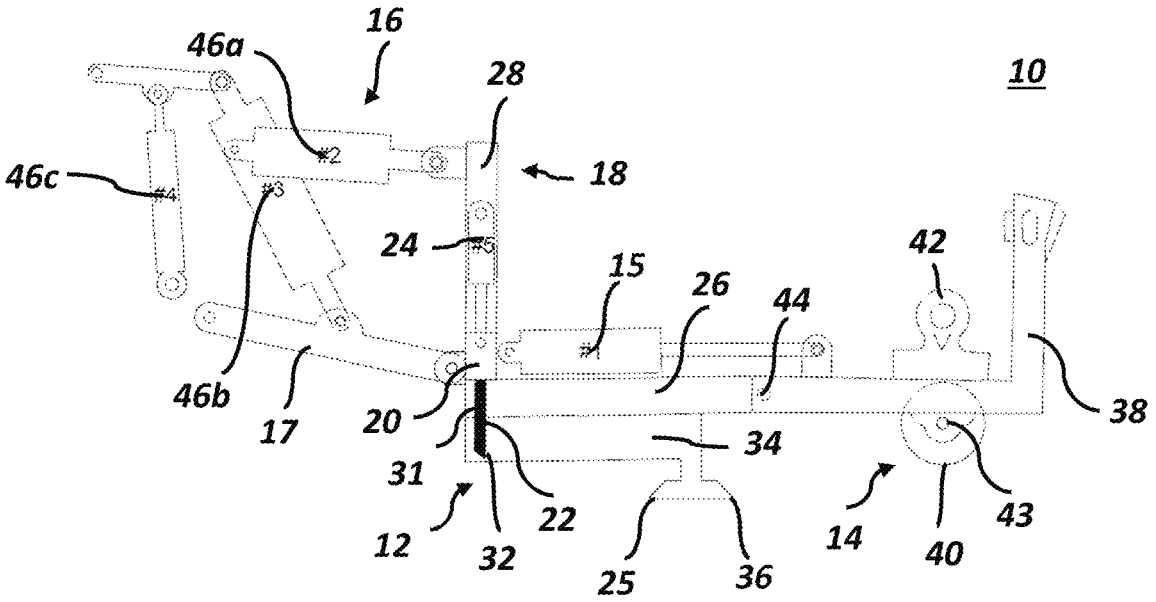
FIG. 3 is a side schematic cross-sectional view of the scarifier device with the integrated retractable roller device of FIG. 1 with the integrated roller device in a float position.
Figure 4:
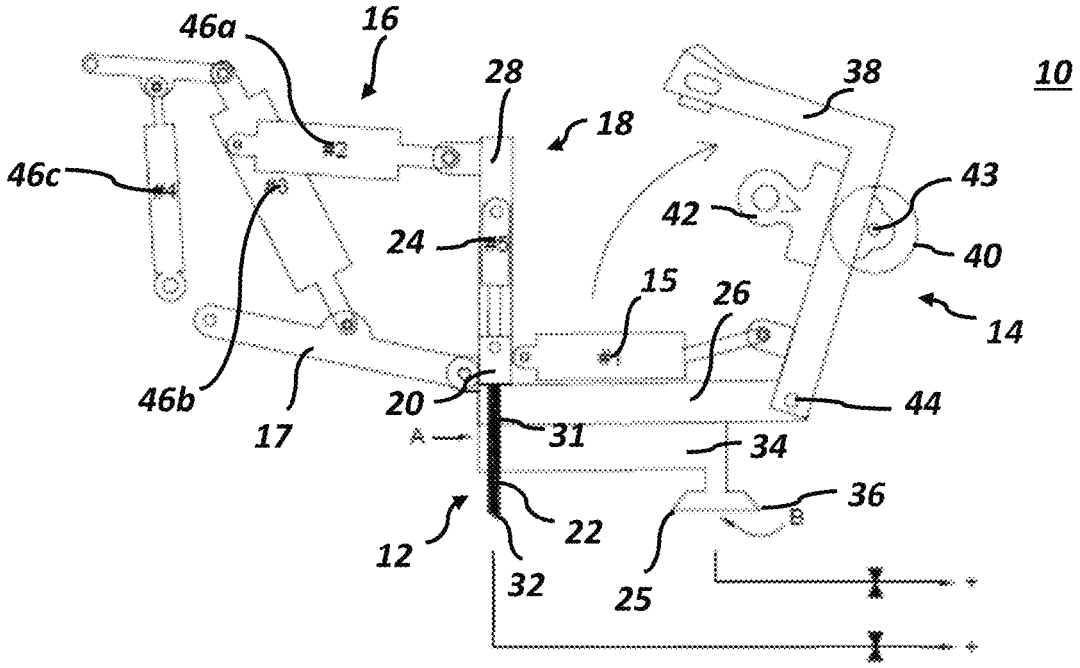
FIG. 4 is a side schematic cross-sectional view of the scarifier device with the integrated retractable roller device of FIG. 1 with the integrated roller device in a partially extended (deployed) position.

The user can operate the integrated roller device 14, through the hydraulic arm 15, to move the roller device 14 to various positions between the fully deployed position shown in FIG. 1 and the fully retracted position shown in FIG. 2. For example, the roller device 14 can be placed in a partially retracted position, such as the position shown in FIG. 4, by way of example only, or to the float position as shown in FIG. 3. In this position (as well as the other variable positions between the position shown in FIG. 1 and the position shown in FIG. 2), the roller 40 variably restricts the natural lifting friction of either the teeth 22 or the blade 25 as the scarifier device 10 is moved in a forward direction. This enhances the angle of attack of either the teeth 22 or the blade 25, and controls the depth of penetration. The depth of penetration can further be adjusted using the three-point hitch device 16 or the position of the roller 40. Further, in the float position as shown in FIG. 3, the elevation of the blade 25 can be controlled by either the teeth 22 or the roller 40. The elevation of the blade 25 can be adjusted in order to separate an aggregate material made up of different sizes of material. For example, the elevation of the blade 25 can be set to remove only material of a certain size during operation based on the positioning of the blade 25 during operation.

Figures 10A, 10B, 10C:
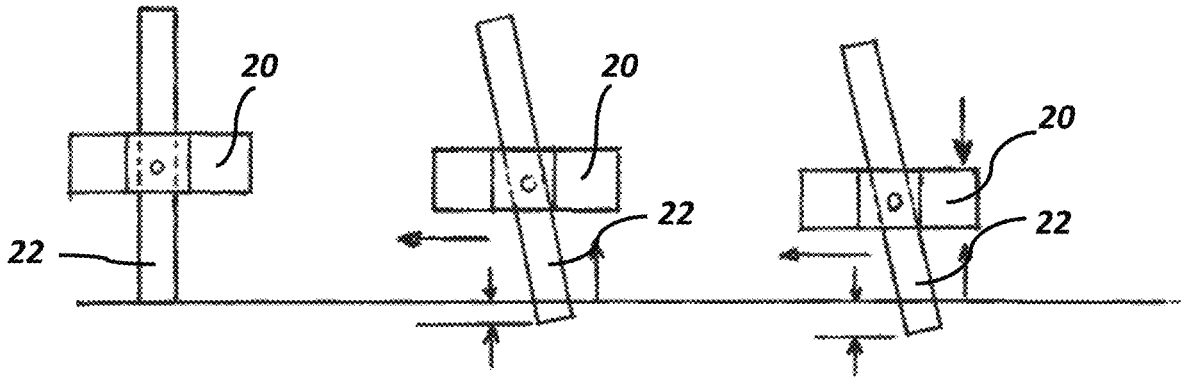
FIGS. 10A-10C illustrate the position of the teeth of the scarifier device during operation with the roller device in various orientations.

FIG. 10A illustrates a tooth in a stationary position (i.e., the scarifier device 10 is not moving. The tooth in this position extends axially downward toward the surface to be acted upon. FIG. 10B illustrates a tooth during operation with the scarifier device 10 moving in a forward direction with the roller device fully extended as shown in FIG. 1. In this configuration, the weight of the roller device 14 is not over the scarifier 12, which results in less penetration of the tooth. FIG. 10C illustrates a tooth during operation with the scarifier device 10 moving in a forward direction with the roller device fully retracted as shown in FIG. 2. In this configuration, the weight of the roller device 14, including the vibration mechanism 42, is over the scarifier 12, which results in increased penetration of the tooth. In this configuration, vibration of the vibration mechanism 42 is directed to the tooth through the cam lock 48. The angle of attack of the tooth is also variable by altering the position of the roller 40 by articulating the roller device 14 to different positions, such as in FIG. 4. The angle of attack of the tooth can also be varied using the three-point hitch 16 to alter the position of the scarifier 12. The variable depth of penetration can be advantageous, for example, in grass removal where there is a need to remove the grass with minimal disruption to the underlying soil.

Next, the user can manipulate the roller device 14 using the hydraulic arm 15 to the fully retracted position as shown in FIG. 2. In the fully retracted position, the roller device 14 is securely held in place above the scarifier 12 by the interaction of the cam lock 48 and the pin mechanism 50, as described above. In this position, the weight of the roller 40 is located above the teeth 22 and the blade 25, which improves penetration, efficiency, and general performance of the scarifier 12, as shown in FIG. 10C. In one example, this configuration provides at least 750 pounds of additional weight over the scarifier 12. The roller device 14 further increases the out of balance weight of the scarifier 12, which results in more radical vibration when the vibration mechanism 42 is employed. The cam lock 48 is advantageously configured, as described above, to hold the roller device 14 securely in place during the use of the vibration mechanism 42.

Figure 11:
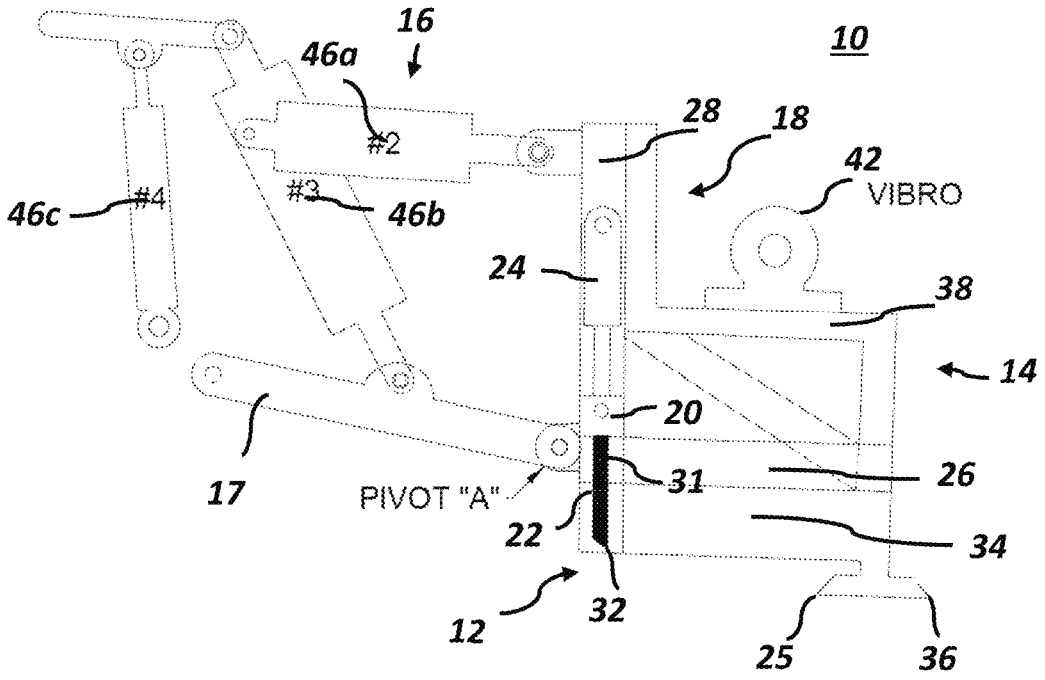
FIG. 11 illustrates the use of a vibration mechanism to utilize the scarifier device as a tamper.

In the fully retracted position, the vibration force during use of the vibration mechanism 42 is directed to the teeth 22 through the cam lock 48. Additionally, as shown in FIG. 11, the vibration mechanism 42 can be used to operate the blade 25 as a tamping device. The retracted position shown in FIG. 2 allows the scarifier device 10 to advantageously be located in close proximity to buildings and other structures, without the need to remove the roller device 14, which was not possible with prior devices. Further, the sides of the device are sloped to allow the scarifier device 10 can get closer to building or other obstructions.

Accordingly, as illustrated and described by way of the examples herein, this technology provides an improved scarifier for scarifying and levelling gravel roadways, parking lots, and the like, that incorporates an integrated roller device that can be manipulated by articulation to provide greater efficiency and improved scarifying and/or levelling operations.

Having thus described the basic concept of the invention, it will be rather apparent to those skilled in the art that the foregoing detailed disclosure is intended to be presented by way of example only and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A scarifier device comprising:

a scarifier comprising a scarifier support frame having a plurality of downwardly depending scarifying teeth secured thereto;

an integrated roller device having a compaction roller on a roller support frame, the integrated roller device pivotally coupled to the scarifier support frame; and a hydraulic arm positioned between the scarifier support frame and the roller support frame to articulate the roller device between a deployed position wherein the integrated roller device extends from the scarifier and a retracted position wherein the roller is positioned above the scarifer, wherein the hydraulic arm is configured to articulate the roller device to a float position between the deployed position and the retracted position, wherein the roller device extends horizontally from the scarifier.

2. The scarifier device of claim 1 further comprising:

a cam lock located on the scarifier support frame and configured to secure the integrated roller device, with the roller positioned above the scarifier, in the retracted position.

3. The scarifier device of claim 2, wherein the cam lock comprises a mainframe and a locking portion coupled at a pivot point, wherein the pivot point is offset from a central axis of the mainframe.

4. The scarifier device of claim 3, wherein the pivot point is offset from the centerline of the mainframe by at least 8 degrees.

5. The scarifier device of claim 1 further comprising:

a vibration device located on the integrated roller device and configured to provide vibration of the integrated roller device during use.

6. The scarifier device of claim 1 further comprising:

at least one unloader arm coupled to the scarifier support frame and configured to couple the scarifier device to a tractor, wherein the unloader arm comprises a hydraulic cylinder comprising a piston rod, wherein the unloader arm comprises a locking mechanism configured to protect the piston rod from impacts during operation of the scarifier device.

7. A method of making a scarifier device comprising:

providing a scarifier comprising a scarifier support frame having a plurality of downwardly depending scarifying teeth secured thereto;

pivotally coupling an integrated roller device having a compaction roller on a roller support frame to the scarifier support frame; and positioning a hydraulic arm between the scarifier support frame and the roller support frame to articulate the roller device between a deployed position wherein the integrated roller device extends from the scarifier and a retracted position wherein the roller is positioned above the scarifer, wherein the hydraulic arm is configured to articulate the roller device to a float position between the deployed position and the retracted position, wherein the roller device extends horizontally from the scarifier.

8. The method of claim 7 further comprising:

locating a cam lock on the scarifier support frame configured to secure the integrated roller device, with the roller positioned above the scarifier, in the retracted position.

9. The method of claim 8, wherein the cam lock comprises a mainframe and a locking portion coupled at a pivot point, wherein the pivot point is offset from a central axis of the mainframe.

10. The method of claim 9, wherein the pivot point is offset from the centerline of the mainframe by at least 8 degrees.

11. The method of claim 7 further comprising:

providing a vibration device located on the integrated roller device configured to provide vibration of the integrated roller device during use.

12. The method of claim 7 further comprising:

providing at least one unloader arm coupled to the scarifier support frame and configured to couple the scarifier device to a tractor, wherein the unloader arm comprises a hydraulic cylinder comprising a piston rod, wherein the unloader arm comprises a locking mechanism configured to protect the piston rod from impacts during operation of the scarifier device.

13. A method of compacting a surface, the method comprising:

providing a scarifier device comprising:

a scarifier comprising a scarifier support frame having a plurality of downwardly depending scarifying teeth secured thereto;

an integrated roller device having a compaction roller on a roller support frame, the integrated roller device pivotally coupled to the scarifier support frame; and a hydraulic arm positioned between the scarifier support frame and the roller support frame to articulate the roller device between a deployed position wherein the integrated roller device extends from the scarifier and a retracted position wherein the roller is positioned above the scarifer, wherein the hydraulic arm is configured to articulate the roller device to a float position between the deployed position and the retracted position, wherein the roller device extends horizontally from the scarifier;

positioning the roller device in the deployed position using the hydraulic arm;

suspending the scarifier device above the surface to apply a downward force on the roller device; and varying the downward force on the roller by manipulating the roller device using the hydraulic arm.

14. The method of claim 13, wherein the integrated roller device further comprises a vibration device located thereon configured to provide vibration of the integrated roller device during use, the method further comprising:

activating the vibration device during the application of the downward force on the roller device.

15. A method of scarifying a surface, the method comprising:

providing a scarifier device comprising:

a scarifier comprising a scarifier support frame having a plurality of downwardly depending scarifying teeth secured thereto;

an integrated roller device having a compaction roller on a roller support frame, the integrated roller device pivotally coupled to the scarifier support frame; and a hydraulic arm positioned between the scarifier support frame and the roller support frame to articulate the roller device between a deployed position wherein the integrated roller device extends from the scarifier and a retracted position wherein the roller is positioned above the scarifer, wherein the hydraulic arm is configured to articulate the roller device to a float position between the deployed position and the retracted position, wherein the roller device extends horizontally from the scarifier; and positioning the roller device in one or more positions between the deployed position and the retracted position using the hydraulic arm to variably restrict lifting friction of the scarifying teeth during movement of the scarifier device.

16. The method of claim 15 further comprising:

positioning the roller device in the retracted position using the hydraulic arm to provide additional weight over the scarifying teeth; and moving the scarifier device to scarify the surface with the roller device positioned in the retracted position with the roller positioned above the scarifier.

* * * * *